US008021017B2

(12) United States Patent
Cheng

(10) Patent No.: US 8,021,017 B2
(45) Date of Patent: Sep. 20, 2011

(54) LED LAMP HAVING IMPROVED HEAT DISSIPATION STRUCTURE

(76) Inventor: Sheng-Hsiung Cheng, Shu Lin (TW)

( * ) Notice: Subject to any disclaimer, the term of this patent is extended or adjusted under 35 U.S.C. 154(b) by 334 days.

(21) Appl. No.: 12/469,711

(22) Filed: May 21, 2009

(65) Prior Publication Data

US 2010/0296286 A1 Nov. 25, 2010

(51) Int. Cl.
*F21V 21/00* (2006.01)

(52) U.S. Cl. ..... 362/249.02; 362/294; 362/373; 362/631; 362/646; 362/650

(58) Field of Classification Search ..... 362/249.02, 362/294, 373, 631, 646, 650
See application file for complete search history.

(56) References Cited

U.S. PATENT DOCUMENTS 7,794,099 B2 * 9/2010 Wang et al. ..... 362/97.3
2006/0268550 A1 * 11/2006 Lin ..... 362/294
2010/0295437 A1 * 11/2010 Cheng ..... 313/46

* cited by examiner

*Primary Examiner* — Stephen F Husar
*Assistant Examiner* — James Cranson, Jr.
(74) *Attorney, Agent, or Firm* — Leong C. Lei

(57) ABSTRACT

The LED lamp contains one or more base plates, each having a plurality of through terminal holes connected by a patterned conduction layer. The base plates are separated by support tubes and a number of LEDs have their terminals threaded through the terminal holes and soldered to the conduction layers of the base plates. When the LEDs are turned on, the produced heat is dissipated first by the lengthy terminals of the LEDs between the base plates, and then by the extended conduction layers along the base plates. A large number of LEDs therefore could be packed into an even smaller space and the LED lamp has an even lower production cost.

9 Claims, 10 Drawing Sheets

LED LAMP HAVING IMPROVED HEAT DISSIPATION STRUCTURE

TECHNICAL FIELD OF THE INVENTION

The present invention generally relates to lamps using LEDs as light source, and especially relates to a LED lamp having a simplified yet effective heat dissipation structure.

DESCRIPTION OF THE PRIOR ART

As light emitting diodes (LEDs) have advantages such as low power consumption and high brightness, they have gained widely applications in various lighting products. However, as considerable heat is produced when the LED is turned on and the LED's life span and functionality would be affected, a heat dissipation structure is usually adopted to maintain the functionality of the LED. A conventional heat dissipation structure of a LED lamp uses heat dissipation pieces of large surface area as a major means to heat dissipation. The LED lamp therefore suffers disadvantages such as a bulky size and high production cost.

SUMMARY OF THE INVENTION

Therefore, a major objective of the present invention is to provide a LED lamp having a simplified yet effective heat dissipation structure so that the LED lamp could have a smaller size and a lower production cost for enhanced product competitiveness.

A LED lamp according to the present invention contains one or more base plates, each having a plurality of through terminal holes connected by a patterned conduction layer. The base plates are separated by support tubes and a number of LEDs have their terminals threaded through the terminal holes and soldered to the conduction layers of the base plates. When the LEDs are turned on, the produced heat is dissipated first by the lengthy terminals of the LEDs between the base plates, and then by the extended conduction layers along the base plates. A large number of LEDs therefore could be packed into an even smaller space and the LED lamp has an even lower production cost.

According to the present invention, the base plate could be a circuit board and the conduction layer could be the printed circuit layout on the circuit board.

According to the present invention, the printed circuit could be on a single side or on both sides of the circuit board so as to increase the heat dissipation area.

According to the present invention, the support tubes could be replaced by conduction pieces to separate the base plates. Each conduction piece joins two adjacent terminals of the same polarity from two adjacent LEDs. The produced heat therefore could be additionally dissipated by the large-area conduction pieces for enhanced heat dissipation efficiency.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
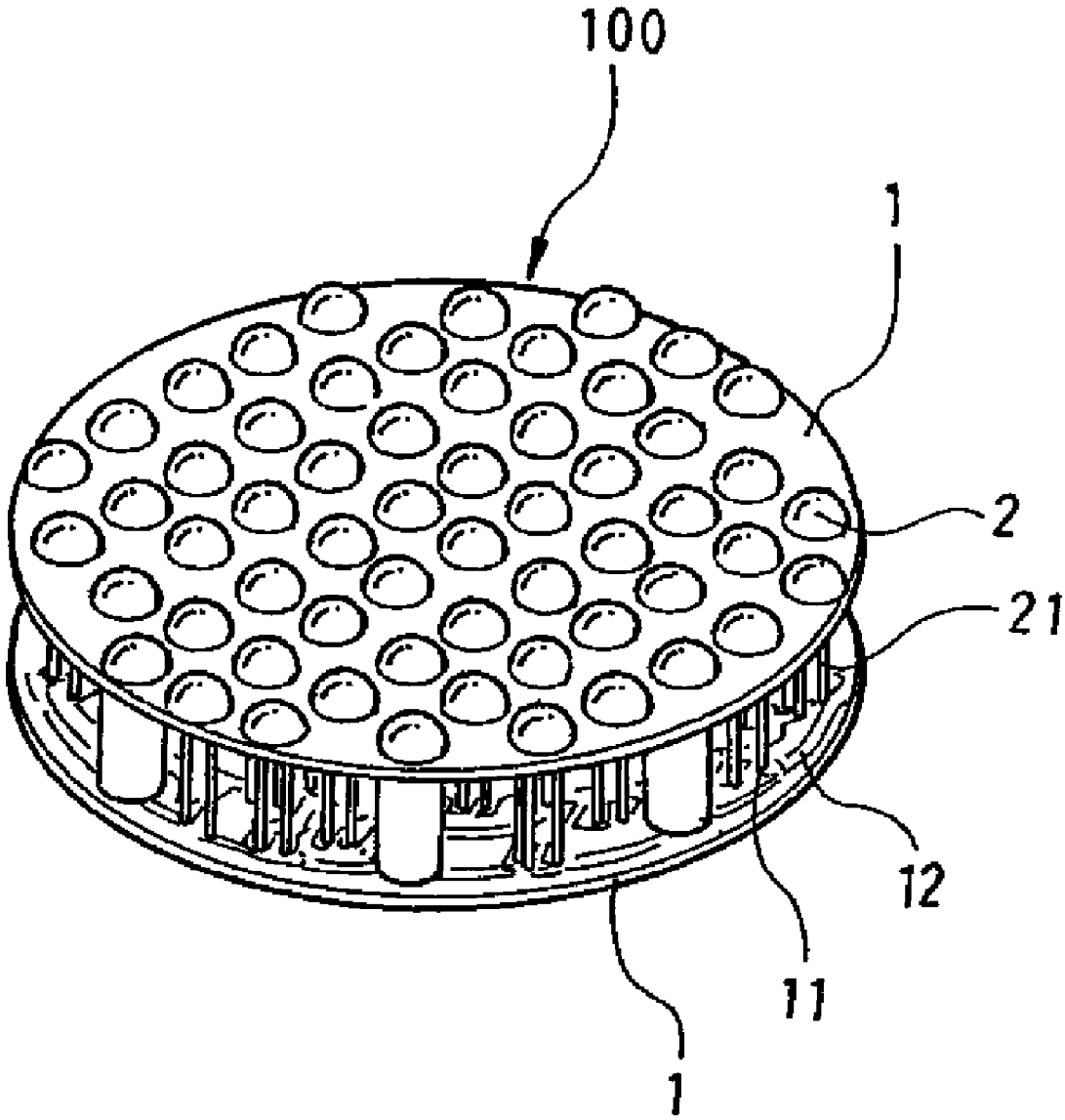
FIG. 1 is a perspective diagram showing a LED lamp according to a first embodiment of the present invention.
Figure 2:
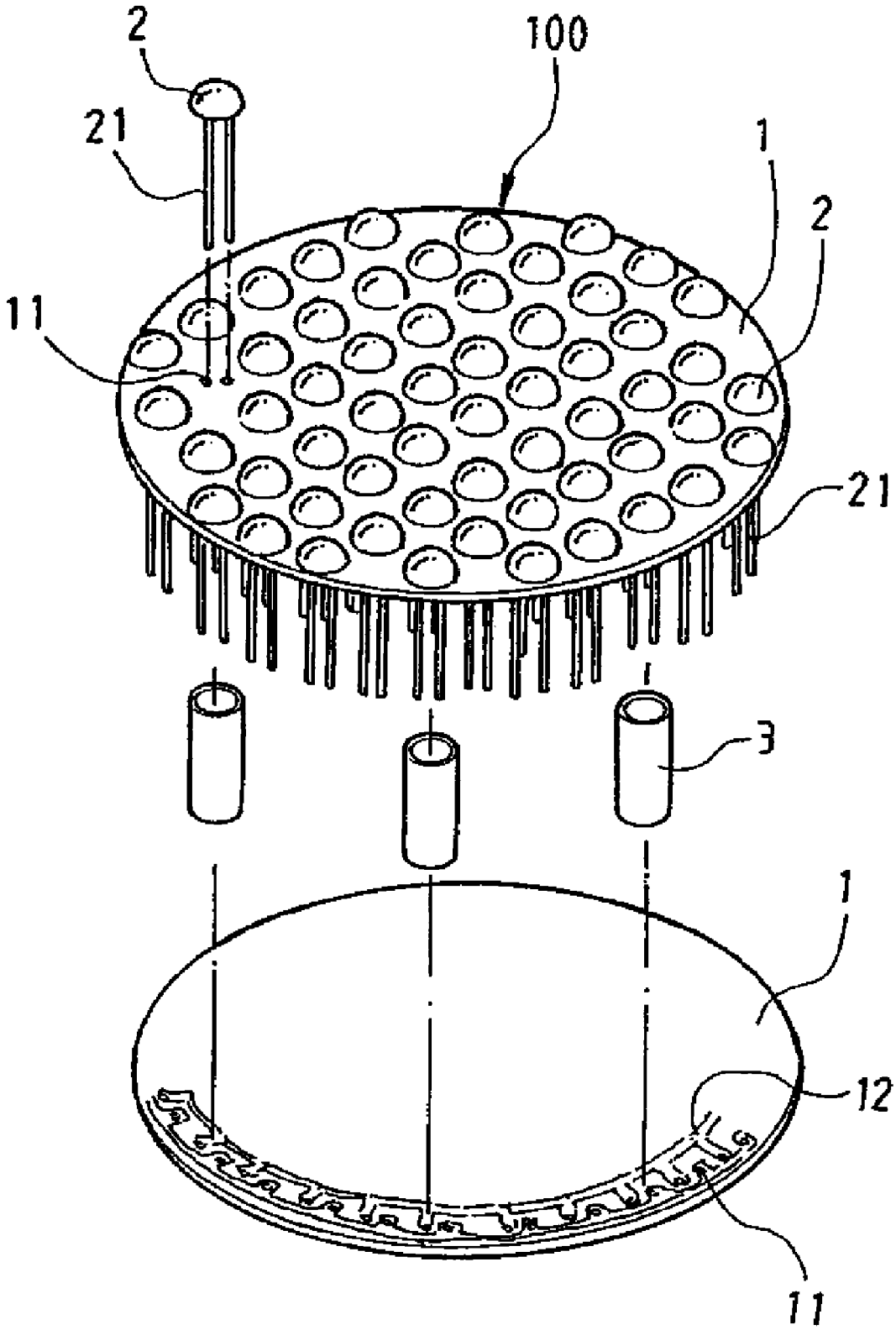
FIG. 2 is a perspective break-down diagram showing the LED lamp of FIG. 1.

As shown in FIGS. 1 and 2, a LED lamp 100 according to a first embodiment of the present invention contains one or more base plates 1 which contains a number of through terminal holes 11 electrically connected by a patterned conduction layer 12. In the present embodiment, the base plate 1 is a circuit board and the conduction layer 12 is the circuit printed on the circuit board 1. The circuit printed on the circuit board could be single-sided or dual-sided.

The LED lamp is assembled as follows. A number of LEDs 2 have their terminals 21 threaded through the terminal holes 11 of a first base plate 1. Please note that the terminals 21 of the LEDs 2 have an appropriate length. A number of hollow support tubes 3 of an appropriate length are positioned at appropriate spacing between the first base plate 1 and a second base plate 1, and are sleeved over the terminals 21 of some LEDs 2. The terminals 21 of the LEDs 2 are then threaded through the terminal holes 11 of the second base plate 1. As such, the first and second base plates 1 are separated by the support tubes 3. The terminals 21 of the LEDs 2 are soldered to the conduction layers 12 of the first and second base plates 1.

The assembly of the LED lamp 100 is completed as described above. After electricity is introduced into the conduction layer 12, the LEDs 2 are then turned on. The heat produced by the LEDs 2 is dissipated first by the lengthy terminals 21 and then further dissipated by the extended conduction layers 12. As such, even a large number of LEDs 2 could be packed into a small LED lamp 100. With the simplified dissipation structure described above, the production cost of the LED lamp 100 could be further reduced.

Figure 3:
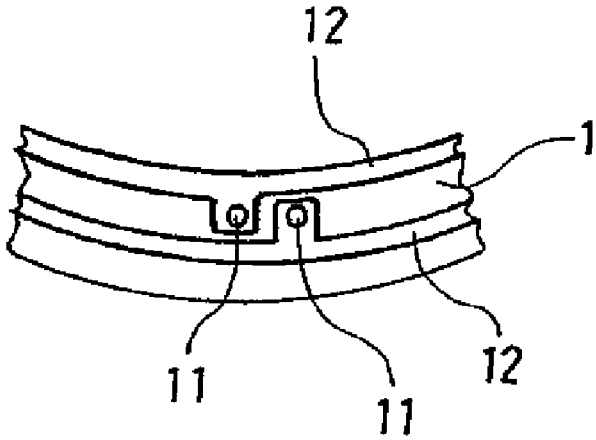
FIG. 3 is a schematic top-view diagram showing an embodiment of the conduction layer of the LED lamp of the present invention.
Figure 4:
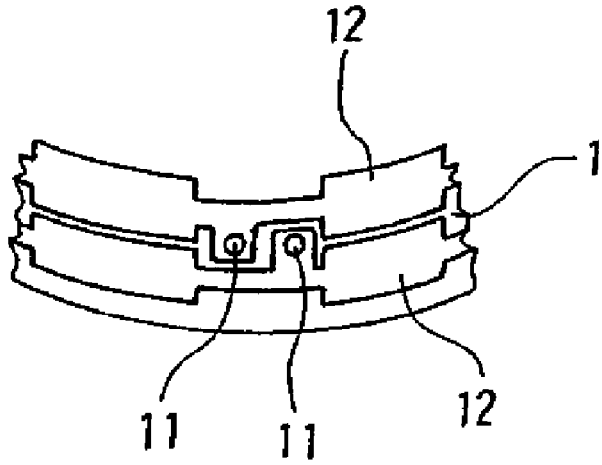
FIG. 4 is a schematic top-view diagram showing another embodiment of the conduction layer of the LED lamp of the present invention.

FIGS. 3 and 4 show two embodiments of the conduction layer 12. As illustrated, the conduction layer 12 is patterned on the base plate 1 so as to form a significant heat dissipation area. As the LEDs 2 have their terminals 21 soldered to the conduction layer 12, the produced heat would be conducted to the conduction layer 12 and dissipated. As shown in FIG. 4, if required, the width of traces of the conduction layer 12 could be increased to further enhance the heat dissipation efficiency.

Figure 5:
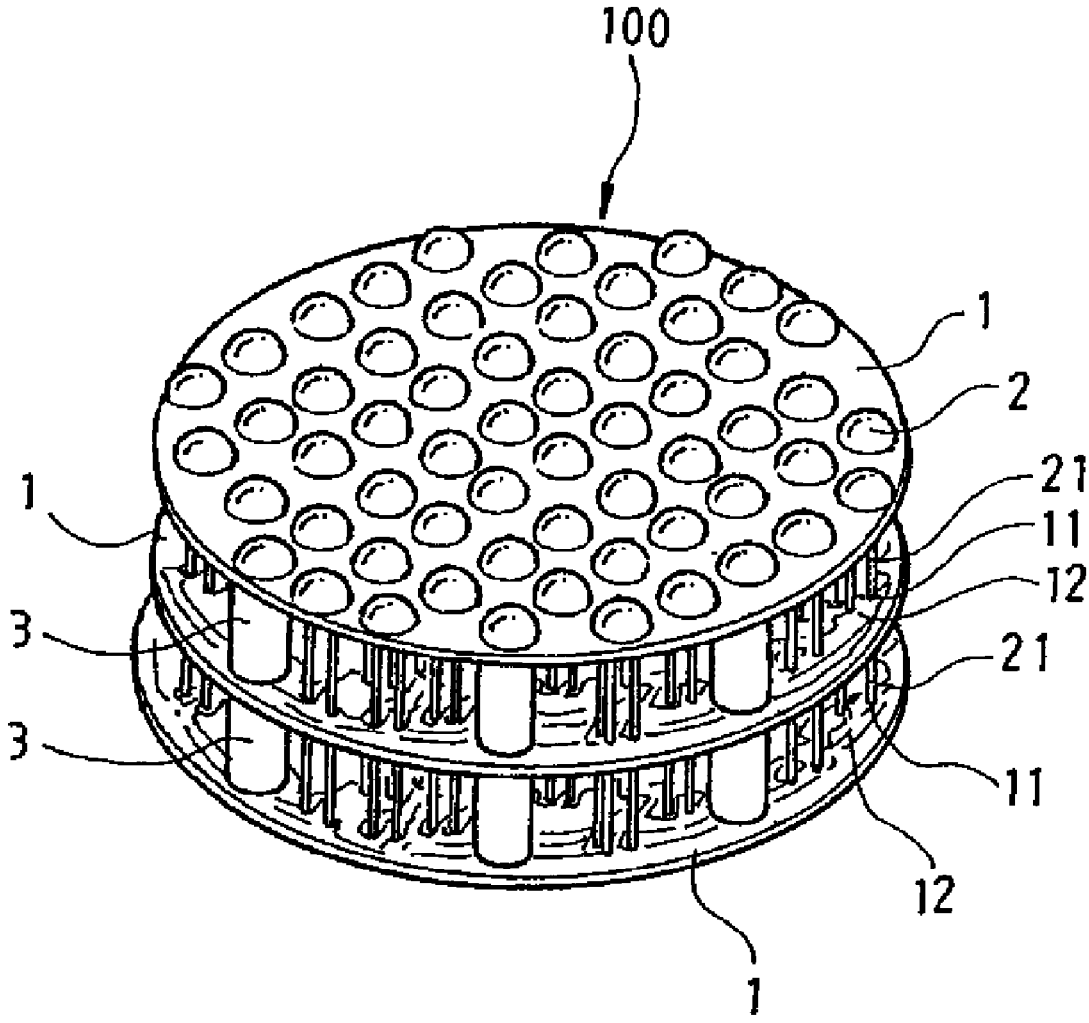
FIG. 5 is a perspective diagram showing a LED lamp according to a second embodiment of the present invention.

FIG. 5 shows a second embodiment of the present invention. As illustrated, an additional base plate 1 is adopted if high-power LEDs 2 are used in the LED lamp 100. Again, the terminals 21 of the LEDs 2 are of an appropriate length. The LEDs 2 have their terminals 21 threaded through the terminal holes 11 of a first base plate 1, a second base plate 1, and a third base plate 1. A number of hollow support tubes 3 of an appropriate length are positioned at appropriate spacing between the first base plate 1 and a second base plate 1, and between the second base plate 1 and the third base plate 1. The support tubes 3 are sleeved over the terminals 21 of some LEDs 2. The terminals 21 of the LEDs 2 are soldered to the conduction layers 12 of the first, second, and third base plates 1. When the LEDs 2 are turned on, the produced heat is first dissipated by the lengthy terminals 21 between the three base plates 1 and then dissipated by the conduction layers 12 extended along the three base plates 1.

Figure 6:
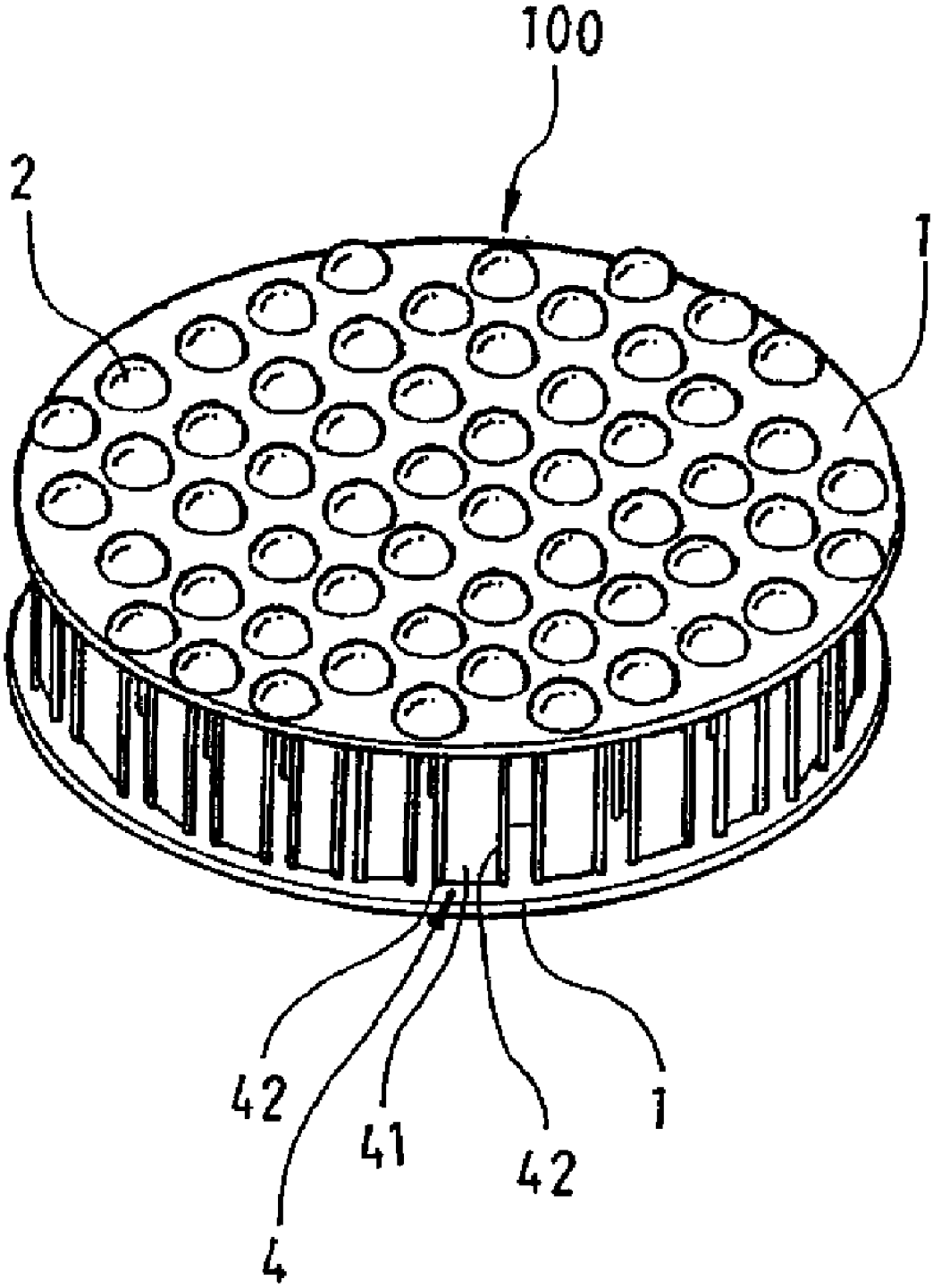
FIG. 6 is a perspective diagram showing a LED lamp according to a third embodiment of the present invention.
Figure 7:
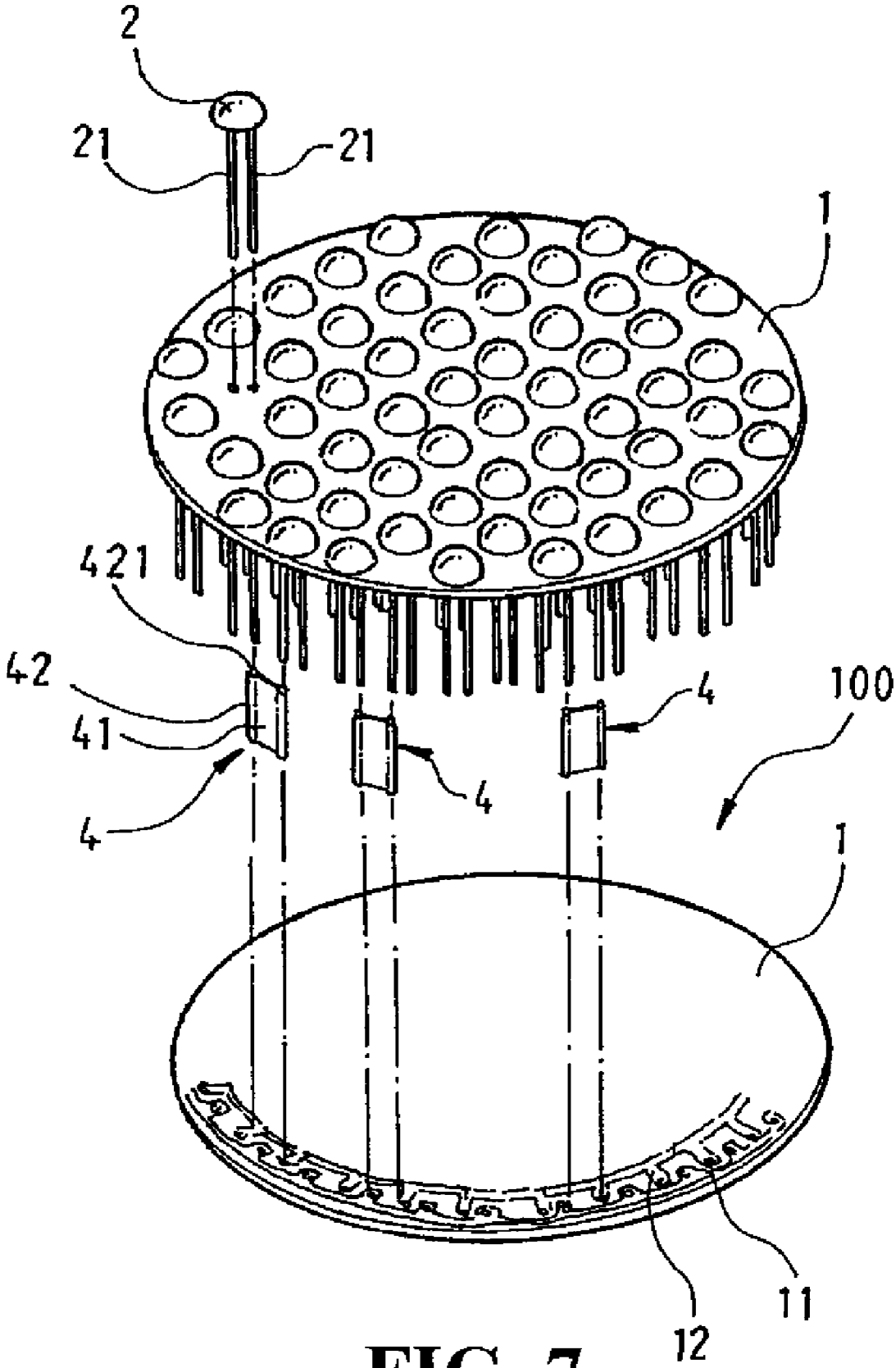
FIG. 7 is a perspective break-down diagram showing the LED lamp of FIG. 6.
Figure 8:
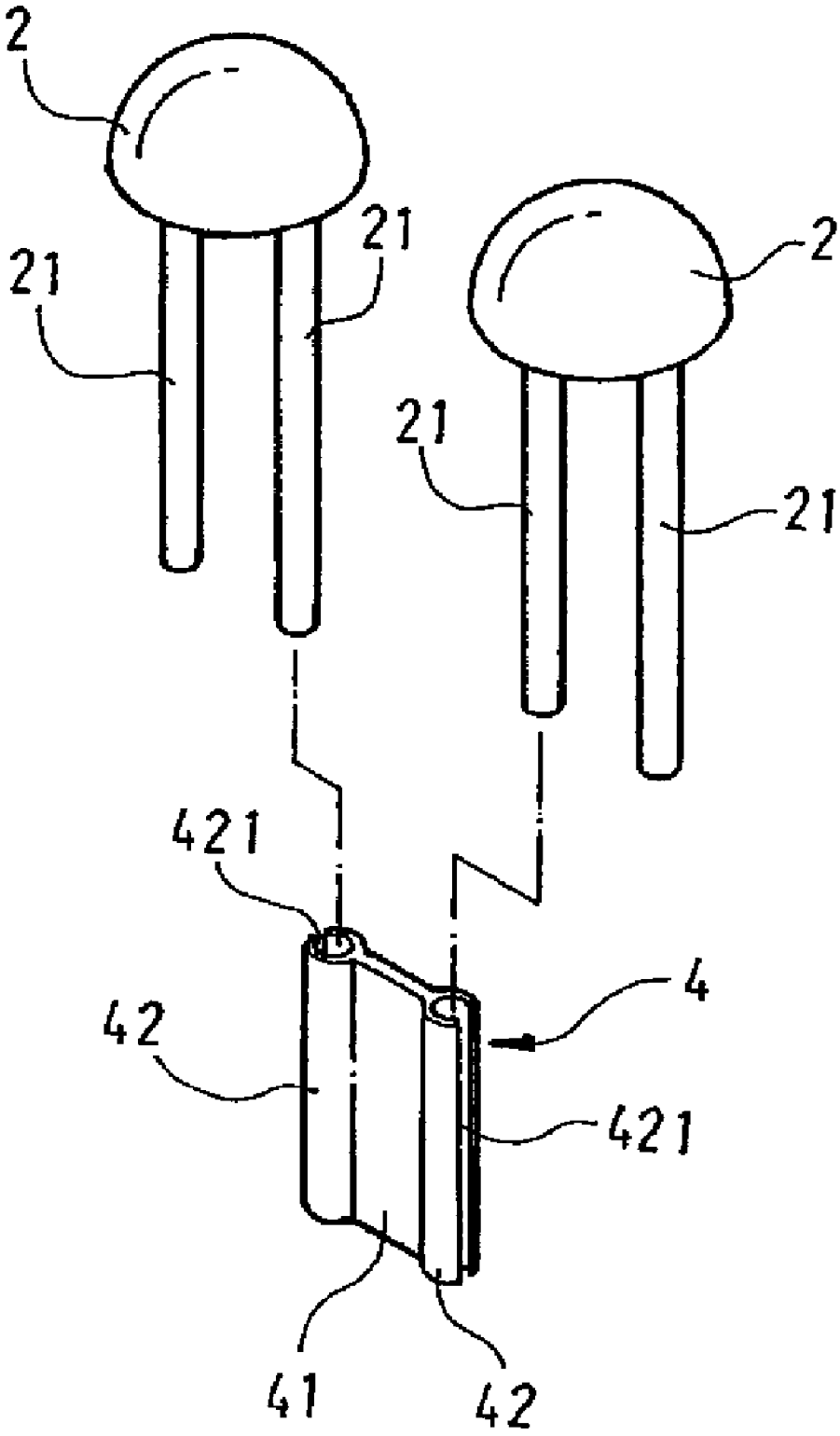
FIG. 8 is a perspective diagram showing the connection of the conduction piece to two LEDs in the LED lamp of FIG. 6.

FIGS. 6, 7, and 8 show a third embodiment of the present invention. As illustrated, instead of using support tubes 3, a number of conduction pieces 4 are adopted. Each conduction piece 4 has a piece body 41 with two threading tubes 42 along two opposing vertical edges of the piece body 41. Each threading tube 42 has an end-to-end vertical slit 421.

To assemble the present embodiment, a number of LEDs 2 have their terminals 21 threaded through the terminal holes 11 of a first base plate 1. Then two adjacent terminals 21 from two adjacent LEDs 2 are threaded through the threading tubes 42 of a conduction piece 4. As such, a number of conduction pieces 4 are installed. Please note that, due to the configuration of the slit 421, each threading tube 42 is flexible to accommodate a terminal 21 and to clamp the terminal 21 reliably. The terminals 21 of the LEDs 2 are then threaded through the terminal holes 11 of a second base plate 1, and soldered to the conduction layers 12 of the first and second base plates 1.

As such, when the LEDs 2 are turned on, the produced heat is first dissipated through the lengthy terminals 21, and then by conduction pieces 4, and also by the conduction layers 12 extended along the base plates 1. Due to the large-area contact to the air by the conduction pieces 4, the present embodiment achieves even better heat dissipation efficiency.

Figure 9:
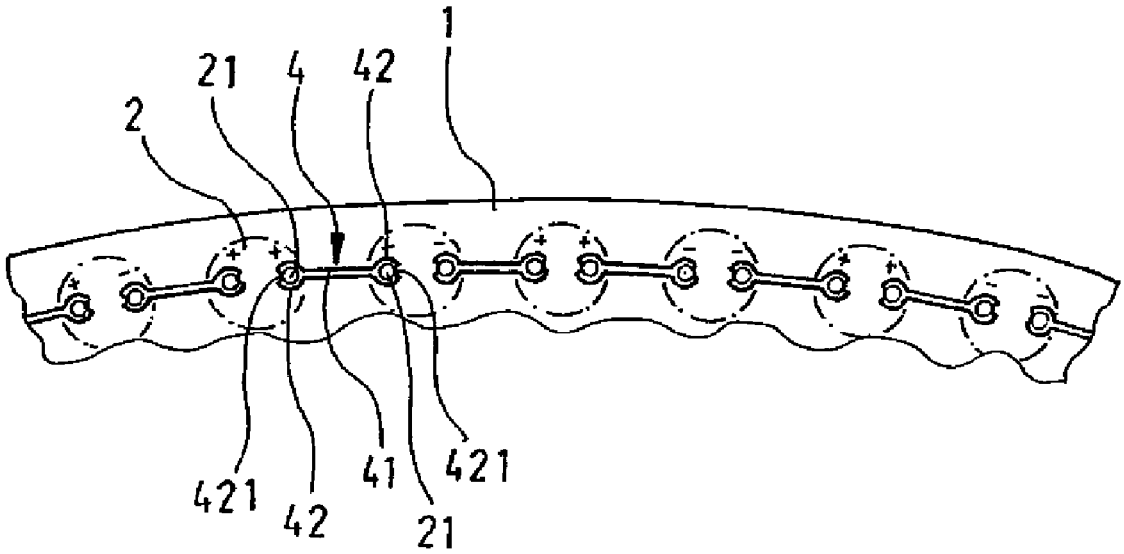
FIG. 9 is a schematic top-view diagram showing the arrangement of the conduction pieces between adjacent LEDs in the LED lamp of FIG. 6.

FIG. 9 illustrates how the conduction pieces 4 are arranged. As shown, each conduction piece 4 is positioned between two adjacent LEDs 2 and two adjacent terminals 21 from the two adjacent LEDs 2 are threaded through the threading tubes 42 of the conduction piece 4. As such, adjacent LEDs 2 should have the polarities of their terminals 21 arranged to follow the pattern: +, −, −, +, +, −, −, +, . . . , and so on. In other words, the LEDs 2 should be arranged so that each conduction piece 4 joins two terminals 21 of the same polarity to avoid short circuit.

Figure 10:
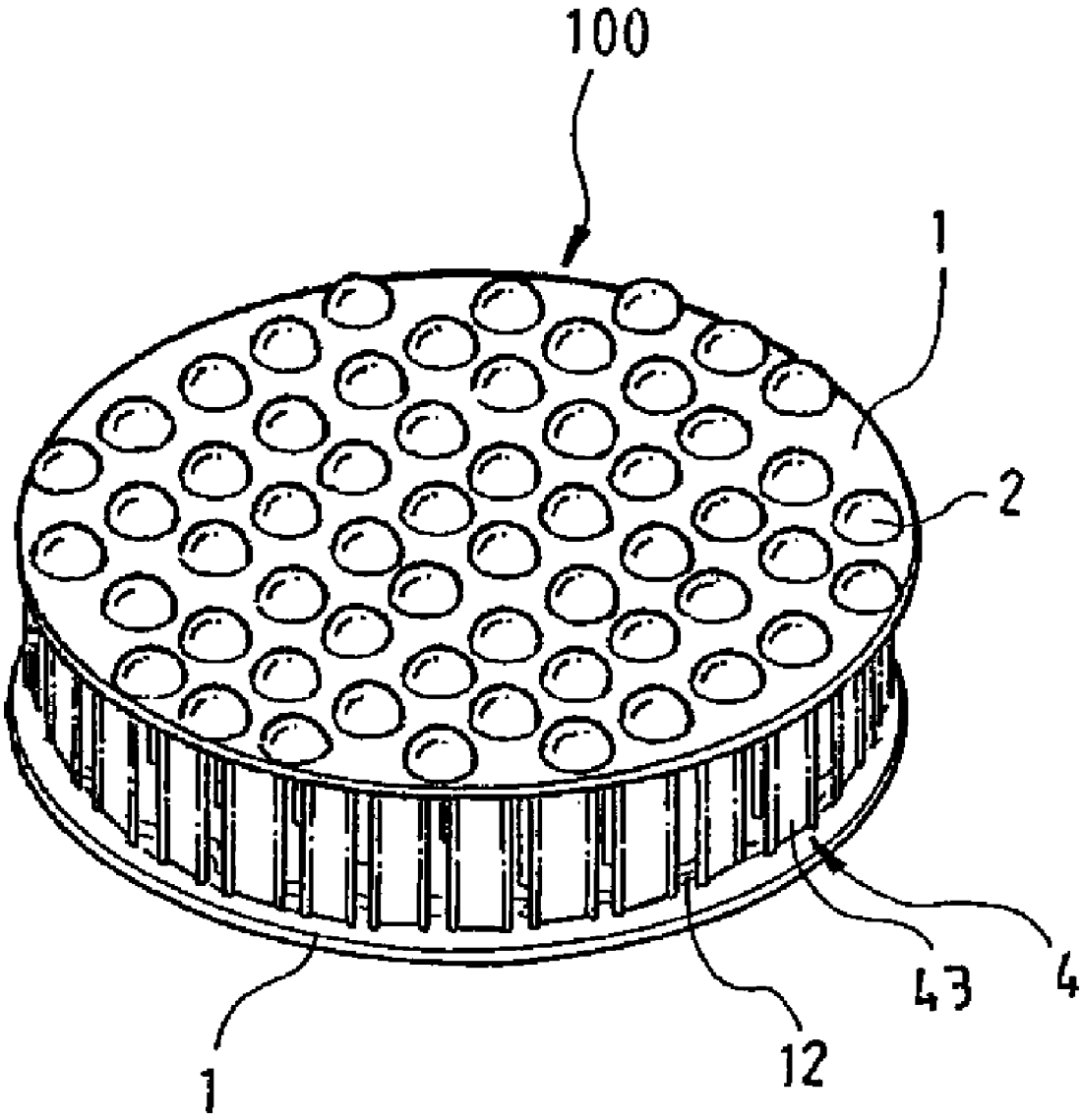
FIG. 10 is a perspective diagram showing a LED lamp according to a fourth embodiment of the present invention.
Figure 11:
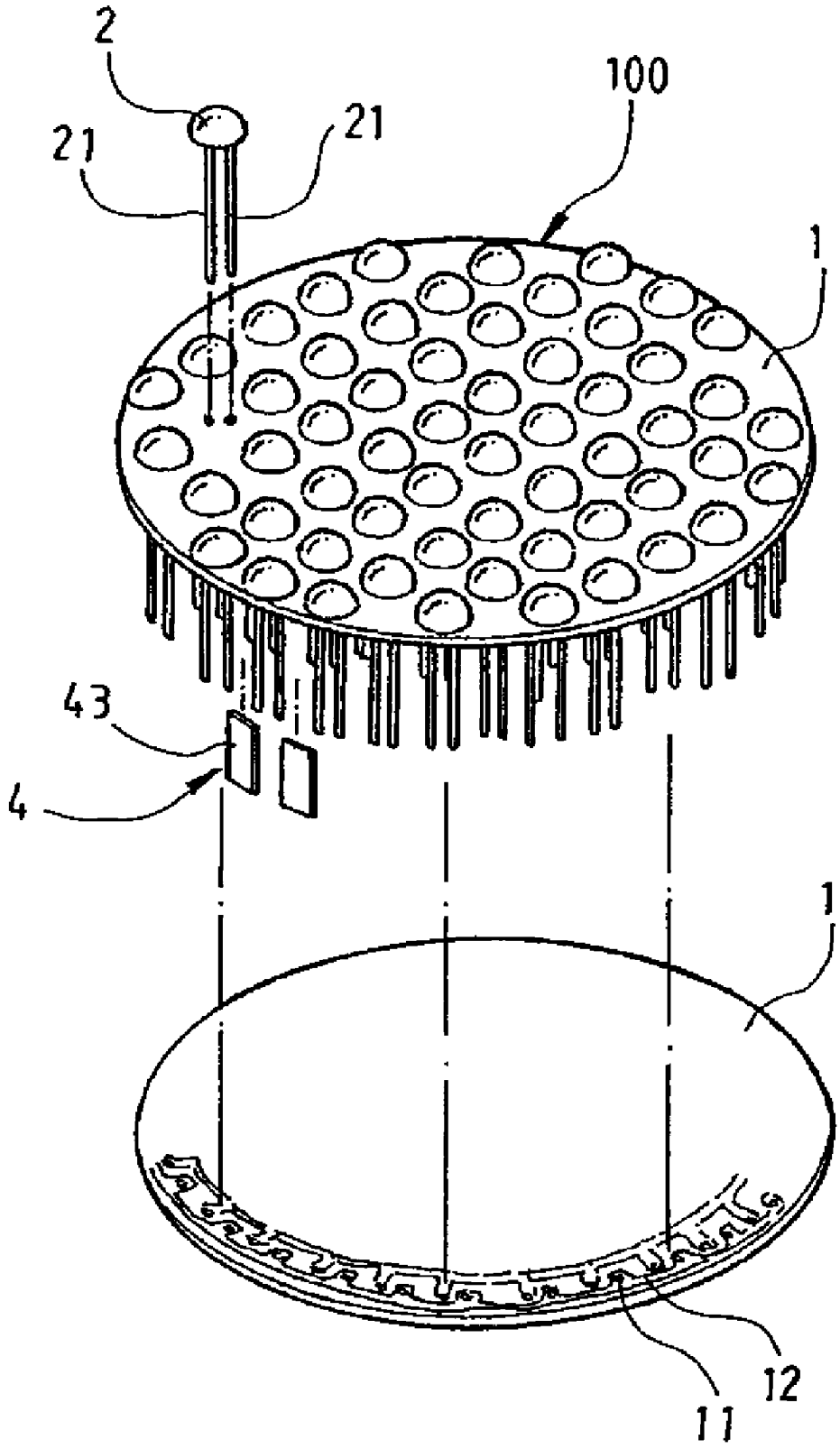
FIG. 11 is a perspective break-down diagram showing the LED lamp of FIG. 10.

As shown in FIGS. 10 and 11, a fourth embodiment of the present invention also adopts conduction pieces 4, similar to the previous third embodiment. Each conduction piece 4 contains only a piece body 43. After the terminals 21 of the LEDs 2 are threaded through a first base plate 1, a number of conduction pieces 4 have their piece bodies 43 soldered two adjacent terminals 21 of the same polarity from two adjacent LEDs 2. The terminals 21 are then threaded through the second base plate 1 so that the conduction pieces 4 separate the base plates 1. The terminals 21 of the LEDs 2 are then soldered the conduction layers 12 of the base plates 1.

As such, when the LEDs 2 are turned on, the produced heat is first dissipated through the lengthy terminals 21, and then by conduction pieces 4, and also by the conduction layers 12 extended along the base plates 1.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A LED lamp, comprising:

a plurality of base plates, each having a plurality of through terminal holes and a patterned conduction layer electrically connecting said terminal holes;

a plurality of LEDs having their terminals threaded through said terminal holes of said base plates and soldered to said conduction layers of said base plates;

a plurality of support tubes between every two adjacent base plates sleeving over said terminals of at least a portion of said LEDs;

wherein, when said LEDs are turned on, heat produced from said LEDs are dissipated by said terminals of said LEDs exposed between said base plates and by said conduction layers extended along said base plates.

2. The LED lamp according to claim 1, wherein each base plate is a circuit board; and said conduction layer is a printed circuit on said circuit board.

3. The LED lamp according to claim 2, wherein said printed circuit is printed on both sides of said circuit board for increased heat dissipation area.

4. A LED lamp, comprising:

a plurality of base plates, each having a plurality of through terminal holes and a patterned conduction layer electrically connecting said terminal holes;

a plurality of LEDs having their terminals threaded through said terminal holes of said base plates and soldered to said conduction layers of said base plates;

a plurality of conduction pieces between every two adjacent base plates, each having a piece body and two threading tubes along two opposing vertical edges of said piece body, each threading tube having an end-to-end slit, said threading tubes of each conduction piece sleeving over two adjacent terminals of a same polarity from two adjacent LEDs;

wherein, when said LEDs are turned on, heat produced from said LEDs are dissipated by said terminals of said LEDs and said conduction pieces exposed between said base plates, and by said conduction layers extended along said base plates.

5. The LED lamp according to claim 4, wherein each base plate is a circuit board; and said conduction layer is a printed circuit on said circuit board.

6. The LED lamp according to claim 5, wherein said printed circuit is printed on both sides of said circuit board for increased heat dissipation area.

7. A LED lamp, comprising:

a plurality of base plates, each having a plurality of through terminal holes and a patterned conduction layer electrically connecting said terminal holes;

a plurality of LEDs having their terminals threaded through said terminal holes of said base plates and soldered to said conduction layers of said base plates;

a plurality of conduction pieces between every two adjacent base plates, each having a piece body whose two opposing vertical edges are soldered to two adjacent terminals of a same polarity from two adjacent LEDs;

wherein, when said LEDs are turned on, heat produced from said LEDs are dissipated by said terminals of said LEDs and said conduction pieces exposed between said base plates, and by said conduction layers extended along said base plates.

8. The LED lamp according to claim 7, wherein each base plate is a circuit board; and said conduction layer is a printed circuit on said circuit board.

9. The LED lamp according to claim 8, wherein said printed circuit is printed on both sides of said circuit board for increased heat dissipation area.

* * * * *